US012376716B2

(12) United States Patent
Raley

(10) Patent No.: US 12,376,716 B2
(45) Date of Patent: Aug. 5, 2025

(54) RETRACTABLE TOILET STEP DEVICE

(71) Applicant: Corie Raley, Fate, TX (US)

(72) Inventor: Corie Raley, Fate, TX (US)

( * ) Notice: Subject to any disclaimer, the term of this patent is extended or adjusted under 35 U.S.C. 154(b) by 172 days.

(21) Appl. No.: 18/219,056

(22) Filed: Jul. 6, 2023

(65) Prior Publication Data

US 2025/0009196 A1 Jan. 9, 2025

(51) Int. Cl.
*A47K 17/02* (2006.01)

(52) U.S. Cl.
CPC ..... *A47K 17/028* (2013.01)

(58) Field of Classification Search
CPC ..... A47K 17/02–028; A47B 2220/05; A47C 12/00–02; A47C 16/025
See application file for complete search history.

(56) References Cited

U.S. PATENT DOCUMENTS

| | | | | | |
|---|---|---|---|---|---|
| 2,698,440 | A | | 1/1955 | Lyons | |
| 3,383,714 | A | | 5/1968 | Minasian | |
| 4,244,064 | A | * | 1/1981 | Parr | A47K 17/028 4/574.1 |
| 4,584,725 | A | * | 4/1986 | Oliver | A47K 17/028 D25/63 |
| 4,615,055 | A | | 10/1986 | Botes | |
| 4,635,303 | A | | 1/1987 | Shih | |
| D629,627 | S | | 12/2010 | Mylet | |
| 10,292,549 | B2 | * | 5/2019 | Kim | A47K 13/10 |
| 10,400,510 | B2 | * | 9/2019 | Niemiec | A47B 88/413 |
| 11,571,094 | B2 | * | 2/2023 | Slothower | A47K 13/24 |
| 11,589,719 | B1 | * | 2/2023 | Luque, Jr. | A47K 17/028 |
| 2012/0227169 | A1 | | 9/2012 | Thyren | |
| 2012/0255108 | A1 | * | 10/2012 | Litchmore | A47K 17/028 4/254 |
| 2018/0020889 | A1 | * | 1/2018 | Hall | A61H 35/006 4/300 |

FOREIGN PATENT DOCUMENTS

| | | | | |
|---|---|---|---|---|
| CA | 1265652 | | 2/1990 | |
| JP | 20051373532 | * | 6/2005 | A47K 17/028 |
| KR | 200384260 | * | 5/2005 | A47K 17/028 |

* cited by examiner

*Primary Examiner* — David P Angwin
*Assistant Examiner* — Nicholas A Ros

(57) ABSTRACT

A retractable toilet step device includes a base that is positionable against a pedestal of a toilet. A pair of straps is each coupled to the base and the straps are extendable around the pedestal of the toilet for securing the base to the toilet. A series of steps is positioned in front of the pedestal of the toilet. The series of steps is positionable in a stored position resting against the base or a deployed position being spaced from the base. The series of steps can be climbed by a child to facilitate the child to urinate into the toilet when the series of steps are in the deployed position. A motion unit is integrated into the series of steps for urging the series of steps between the stored position and the deployed position.

8 Claims, 7 Drawing Sheets

RETRACTABLE TOILET STEP DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toilet step devices and more particularly pertains to a new toilet step device for facilitating a child to urinate into a full sized toilet. The device includes a base that is attached to a pedestal of the toilet, a series of steps positioned in front of the base and a motion unit attached between the series of steps and the base. The motion unit urges the series of steps between a deployed position having the series of steps being spaced from the base to facilitate the child to climb the series of steps and a stored position having the series of steps being positioned against the base.

(2) Description of Related Art Including Information Disclosed Under 37 CFR 1.97 and 1.98

The prior art relates to toilet step devices including a variety of toilet step devices that can either be manually placed against a toilet to assist with urinating in the toilet and a variety of toilet step devices that are pivotally attached to a toilet for pivoting between a deployed position and a stored position. In no instance does the prior art disclose a series of steps that includes a motion unit for automatically urging the series of steps between a deployed position and a stored position.

BRIEF SUMMARY OF THE INVENTION

An embodiment of the disclosure meets the needs presented above by generally comprising a base that is positionable against a pedestal of a toilet. A pair of straps is each coupled to the base and the straps are extendable around the pedestal of the toilet for securing the base to the toilet. A series of steps is positioned in front of the pedestal of the toilet. The series of steps is positionable in a stored position resting against the base or a deployed position being spaced from the base. The series of steps can be climbed by a child to facilitate the child to urinate into the toilet when the series of steps are in the deployed position. A motion unit is integrated into the series of steps for urging the series of steps between the stored position and the deployed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
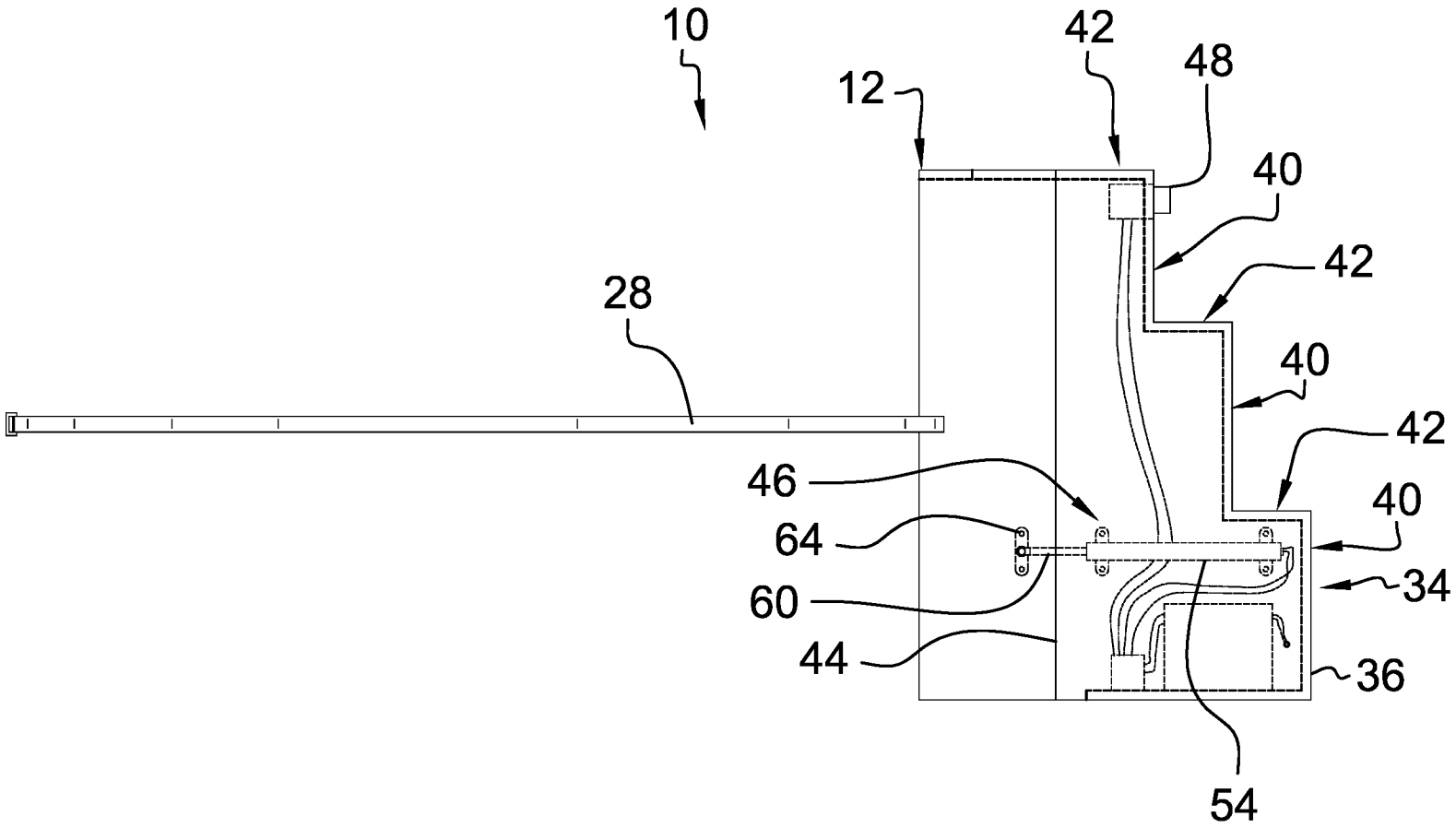
FIG. 1 is a left side phantom view of a retractable toilet step device according to an embodiment of the disclosure showing a series of steps in a stored position.
Figure 2:
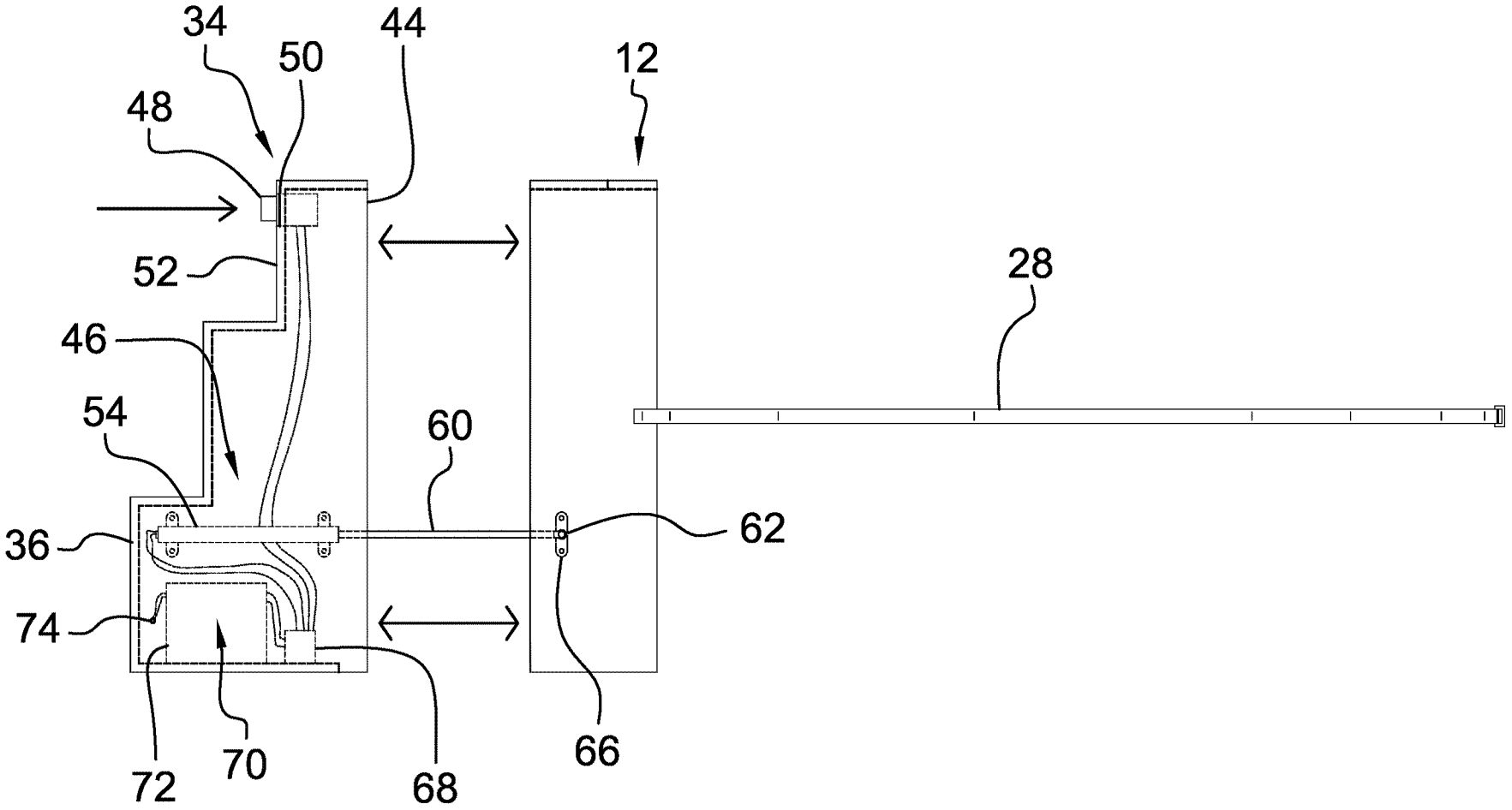
FIG. 2 is a right side phantom view of an embodiment of the disclosure showing a series of steps in a deployed position.
Figure 3:
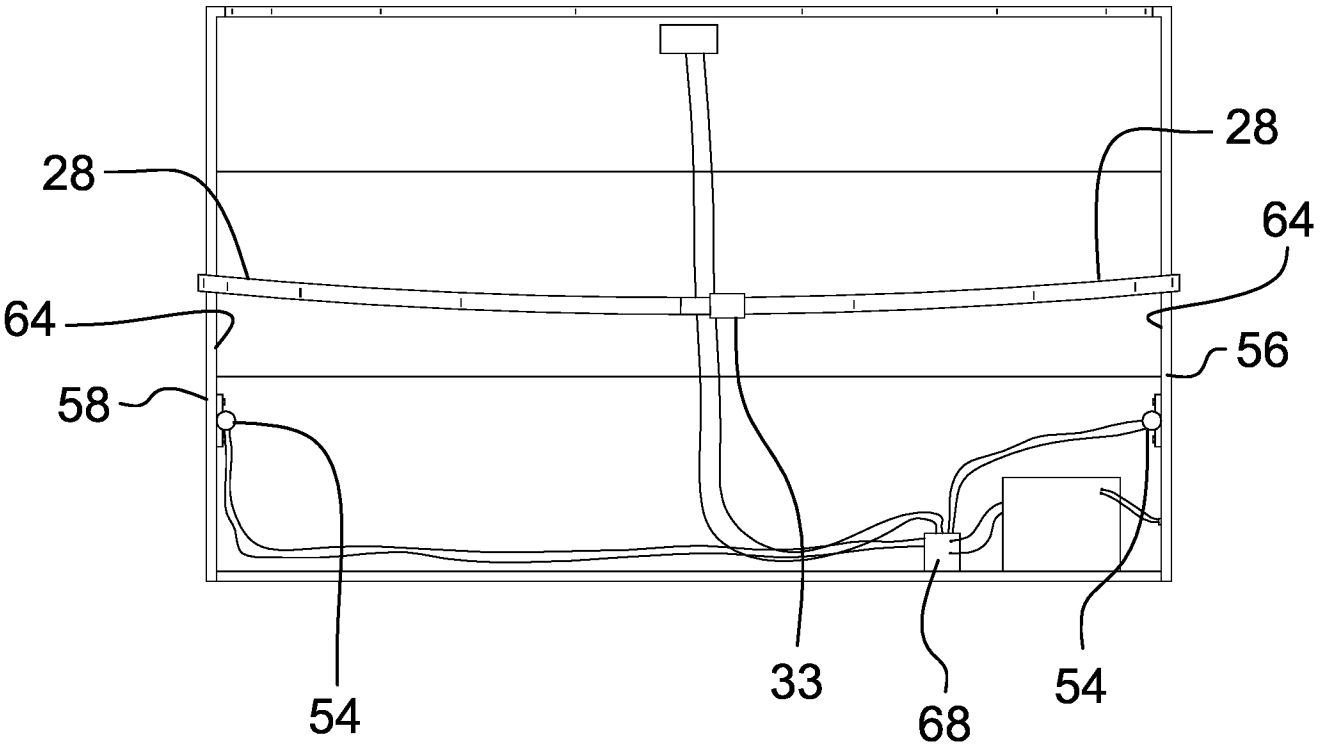
FIG. 3 is a back view of an embodiment of the disclosure.
Figure 4:
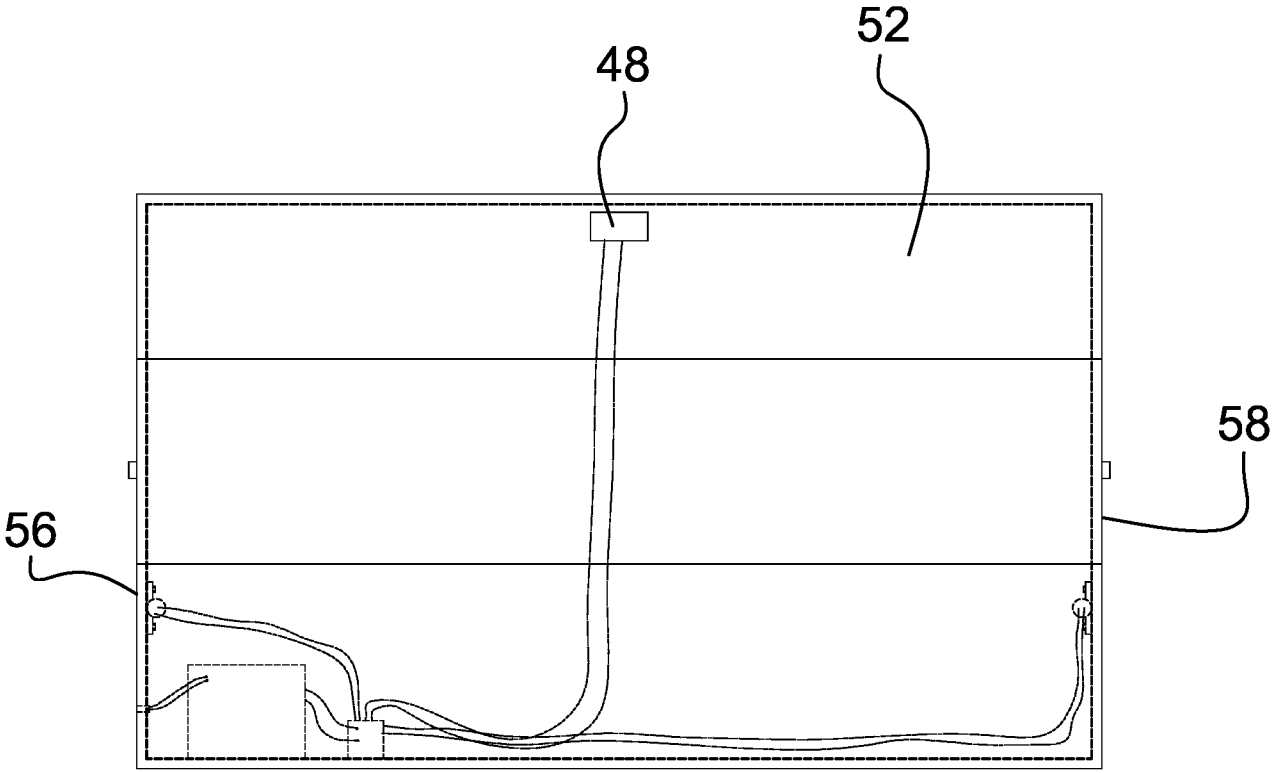
FIG. 4 is a front phantom view of an embodiment of the disclosure.
Figure 5:
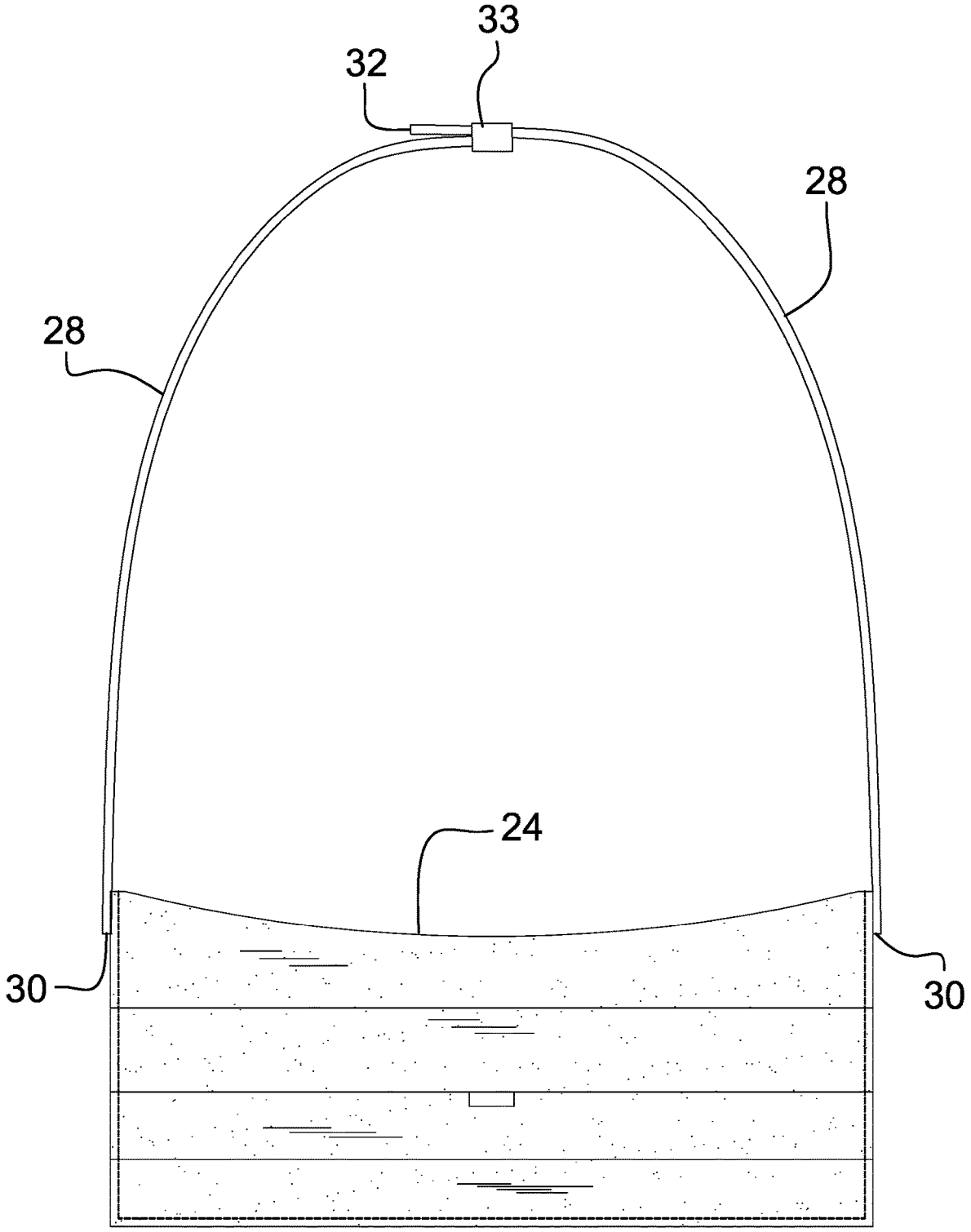
FIG. 5 is a top view of an embodiment of the disclosure.
Figure 6:
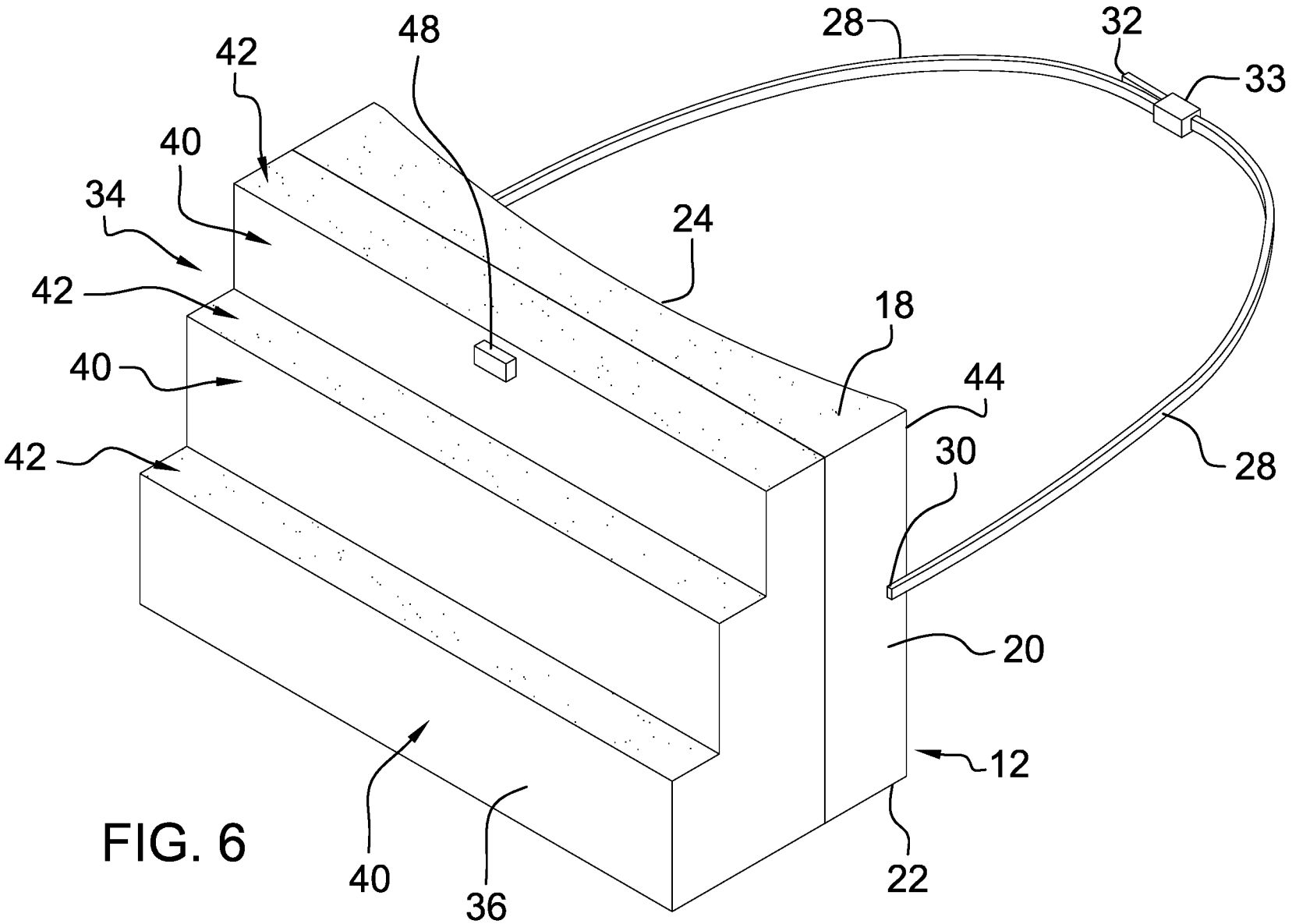
FIG. 6 is a front perspective view of an embodiment of the disclosure.
Figure 7:
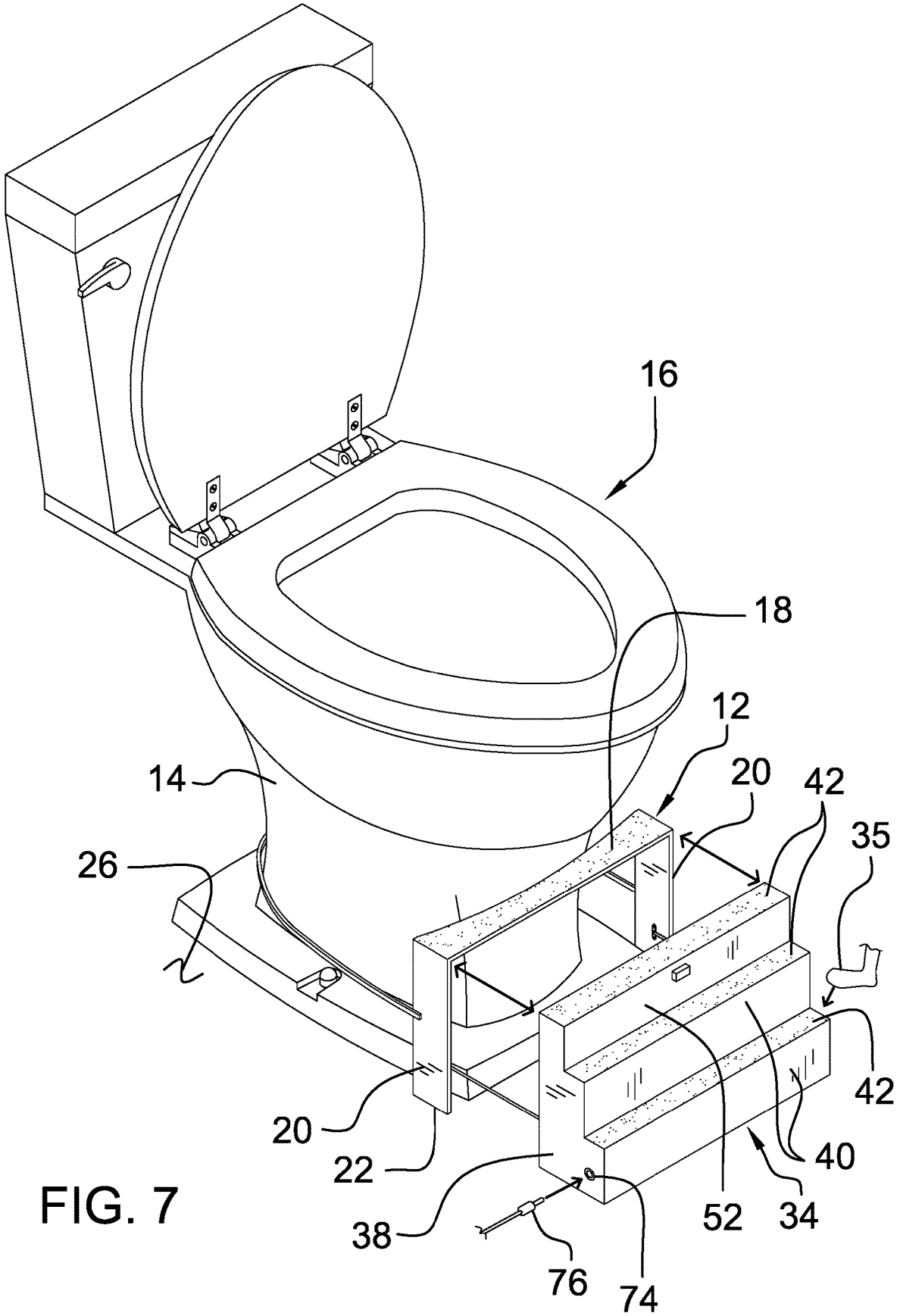
FIG. 7 is a perspective in-use view of an embodiment of the disclosure.

With reference now to the drawings, and in particular to FIGS. 1 through 7 thereof, a new toilet step device embodying the principles and concepts of an embodiment of the disclosure and generally designated by the reference numeral 10 will be described.

As best illustrated in FIGS. 1 through 7, the retractable toilet step device 10 generally comprises a base 12 that is positionable against a pedestal 14 of a toilet 16. The base 12 has a central member 18 which extends between a pair of outward members 20 having the pair of outward members 20 being spaced apart from each other. Each of the outward members 20 has a bottom end 22 and the central member 18 has a rear edge 24 extending between the pair of outward members 20. The rear edge 24 is concavely arcuate between the pair of outward members 20 to facilitate the rear edge 24 to accommodate curvature of the pedestal 14 of the toilet 16 having the bottom end 22 of each of the outward members 20 resting on a support surface 26. The toilet 16 may be a toilet in a public restroom, for example, or other bathroom that would commonly be employed by users of a wide variety of ages and physical abilities.

A pair of straps 28 is provided and each of the straps 28 is coupled to the base 12. The pair of straps 28 is matable to each other for form a closed loop and each of the pair of straps 28 is extendable around the pedestal 14 of the toilet 16 for securing the base 12 to the toilet 16. Each of the straps 28 has a first end 30 and a second end 32 and the first end 30 of each of the pair of straps 28 is coupled to and extends rearwardly from a respective one of the outward members 20 of the base 12. A respective one of the straps 28 has a clasp 33 that is attached to the second end 32 of the respective strap 28 which insertably receives the second end 32 of the other of the pair of straps 28 to form the closed loop of an adjustable diameter.

A series of steps 34 is provided and the series of steps 34 is positioned in front of the pedestal 14 of the toilet 16. The series of steps 34 is positionable in a stored position having the series of steps 34 resting against the base 12. Additionally, the series of steps 34 is positionable in a deployed position having the series of steps 34 being spaced from the base 12. In this way the series of steps 34 can be climbed by a child to facilitate the child to urinate into the toilet 16. Furthermore, the series of steps 34 can be employed by a user 35 with physical limitations that would make urinating in a toilet 16 difficult or impossible without the series of steps 34.

The series of steps 34 has a front wall 36 and an outer wall 38 extending around the front wall 36. The front wall 36 has a series of vertical faces 40 that is each perpendicularly oriented with and is staggered between a series of horizontal faces 42. In this way each of the plurality of horizontal faces 42 defines a respective one of the series of steps 34. The outer wall 38 has a rear edge 44 which defines an opening into the series of steps 34 and each of the horizontal faces 42 is textured to enhance traction for the child. Furthermore, the series of steps 34 are comprised of a fluid impermeable material, including but not being limited to plastic or steel, to facilitate the steps 34 to be easily cleaned of urine and other contaminants.

A motion unit 46 is integrated into the series of steps 34 and the motion unit 46 is attached to the base 12. The motion unit 46 is actuatable into a retracting condition having the series of steps 34 being positioned against the base 12. Conversely, the motion unit 46 is actuatable into an extending condition having the series of steps 34 being spaced from the base 12. The motion unit 46 includes a button 48 which can be depressed for actuating the motion unit 46 between the retracting condition and the extending condition. The series of steps 34 has a hole 50 extending through a topmost one of the series of vertical faces 52 of the front wall 36 of the series of steps 34. The hole 50 is centrally positioned along a width of the topmost vertical face 52 and the button 48 is positioned in the hole 50.

The motion unit 46 includes a pair of actuators 54 that is each attached to an inwardly facing surface 55 of a respective one of a first lateral side 56 and a second lateral side 58 of the outer wall 38 of the series of steps 34. Each of the actuators 54 includes a rod 60 extending outwardly from the outer wall 38 of the series of steps 34. The rod 60 associated with each of the actuators 54 has a distal end 62 that is attached to an interior surface 64 of a respective one of the outward members 20 of the base 12. The rod 60 associated with a respective one of the actuators 54 is extended outwardly from the respective actuator 54 when the respective actuator 54 is actuated into a first condition thereby urging the series of steps 34 away from the base 12. Conversely, the rod 60 associated with the respective actuator 54 is retraced into the respective actuator 54 when the respective actuator 54 is actuated into a second condition thereby urging the series of steps 34 to abut the base 12. Each of the pair of actuators 54 may comprise an electromechanical linear actuator or other type of piston actuator that can lengthen and shorten. Furthermore, as is most clearly shown in FIGS. 1 and 2, each of the actuators may include a coupler 66 that is attached to the interior surface 64 of the respective outward member 20 of the base 12 and which engages the distal end 62 of the rod 60.

The motion unit 46 includes a control unit 68 that is positioned in the series of steps 34. The control unit 68 is electrically coupled between the button 48 and each of the pair of actuators 54. Furthermore, each of the pair of actuators 54 is actuated between the first condition and the second condition each time the button 48 is depressed. The motion unit 46 includes a power supply 70 is integrated into the series of steps 34 and the power supply 70 is electrically coupled to the control unit 68. The power supply 70 comprises a rechargeable battery 72 that is positioned in the series of steps 34 and the rechargeable battery 72 is electrically coupled to the control unit 68. A charge port 74 is recessed into the series of steps 34 thereby facilitating the charge port 74 to insertably receive a charge cord 76. The charge port 74 is electrically coupled to the rechargeable battery 72 for charging the rechargeable battery 72.

In use, each of the straps 28 is extended around the pedestal 14 of the toilet 16 and the pair of straps 28 are mated together to attach the base 12 to the pedestal 14 of the toilet 16. The user 35 depresses the button 48 when the user 35 approaches the toilet 16 to actuate the motion unit 46 to urge the series of steps 34 into the deployed position. In this way the user 35 can climb the series of steps 34 to facilitate the user 35 to urinate into the toilet 16. The user 35 depresses the button 48 when the user 35 has finished urinating to actuate the motion unit 46 to urge the series of steps 34 into the stored position.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A retractable toilet step device to facilitate a child to urinate into a full sized toilet, said device comprising:

a base being positionable against a pedestal of a toilet;

a pair of straps, each of said straps being coupled to said base, said pair of straps being matable to each other to form a closed loop, each of said pair of straps being extendable around said pedestal of said toilet for securing said base to said toilet;

a series of steps being positioned in front of said pedestal of said toilet, said series of steps being positionable in a stored position having said series of steps resting against said base, said series of steps being positionable in a deployed position having said series of steps being spaced from said base wherein said series of steps is configured to be climbed by a child to facilitate the child to urinate into said toilet, said series of steps having a front wall and an outer wall extending around said front wall, said front wall having a series of vertical faces each being perpendicularly oriented with and being staggered between a series of horizontal faces such that each of said plurality of horizontal faces defines a respective one of said series of steps, said outer wall having a rear edge which defines an opening into said series of steps, each of said horizontal faces being textured wherein said series of horizontal faces is configured to enhance traction for the child; and a motion unit being integrated into said series of steps, said motion unit being attached to said base, said motion unit being actuatable into a retracting condition having said series of steps being positioned against said base, said motion unit being actuatable into an extending condition having said series of steps being spaced from said base, said motion unit including a button which can be depressed for actuating said motion unit between said retracting condition and said extending condition, said series of steps having a hole extending through a topmost one of said series of vertical faces of said front wall of said series of steps, said hole being centrally positioned along a width of said topmost vertical face, said button being positioned in said hole.

2. The device according to claim 1, wherein said base has a central member extending between a pair of outward members having said pair of outward members being spaced apart from each other, each of said outward members having a bottom end, said central member having a rear edge extending between said pair of outward members, said rear edge being concavely arcuate between said pair of outward members to facilitate said rear edge to accommodate curvature of said pedestal of said toilet having said bottom end of each of said outward members resting on a support surface.

3. The device according to claim 2, wherein each of said straps has a first end and a second end, said first end of each of said pair of straps being coupled to and extending rearwardly from a respective one of said outward members of said base, a respective one of said straps having a clasp being attached to said second end of said respective strap which insertably receives said second end of the other of said pair of straps to form said closed loop of an adjustable diameter.

4. A retractable toilet step device to facilitate a child to urinate into a full sized toilet, said device comprising:

a base being positionable against a pedestal of a toilet;

a pair of straps, each of said straps being coupled to said base, said pair of straps being matable to each other to form a closed loop, each of said pair of straps being extendable around said pedestal of said toilet for securing said base to said toilet;

a series of steps being positioned in front of said pedestal of said toilet, said series of steps being positionable in a stored position having said series of steps resting against said base, said series of steps being positionable in a deployed position having said series of steps being spaced from said base wherein said series of steps is configured to be climbed by a child to facilitate the child to urinate into said toilet, said series of steps having a front wall and an outer wall extending around said front wall, said front wall having a series of vertical faces each being perpendicularly oriented with and being staggered between a series of horizontal faces such that each of said plurality of horizontal faces defines a respective one of said series of steps, said outer wall having a rear edge which defines an opening into said series of steps, each of said horizontal faces being textured wherein said series of horizontal faces is configured to enhance traction for the child;

a motion unit being integrated into said series of steps, said motion unit being attached to said base, said motion unit being actuatable into a retracting condition having said series of steps being positioned against said base, said motion unit being actuatable into an extending condition having said series of steps being spaced from said base, said motion unit including a button which can be depressed for actuating said motion unit between said retracting condition and said extending condition, said motion unit including a pair of actuators, each of said actuators being attached to an inwardly facing surface of a respective one of a first lateral side and a second lateral side of said outer wall of said series of steps, each of said actuators including a rod extending outwardly from said outer wall of said series of steps, said rod associated with each of said actuators having a distal end being attached to an interior surface of a respective one of said outward members of said base.

5. The device according to claim 4, wherein said rod associated with a respective one of said actuators is extended outwardly from said respective actuator when said respective actuator is actuated into a first condition thereby urging said series of steps away from said base, said rod associated with said respective actuator being retraced into said respective actuator when said respective actuator is actuated into a second condition thereby urging said series of steps to abut said base.

6. The device according to claim 4, wherein said motion unit includes a control unit being positioned in said series of steps, said control unit being electrically coupled between said button and each of said pair of actuators, each of said pair of actuators being actuated between said first condition and said second condition each time said button is depressed.

7. The device according to claim 6, further comprising a power supply being integrated into said series of steps, said power supply being electrically coupled to said control unit, said power supply comprising:

a rechargeable battery being positioned in said series of steps, said rechargeable battery being electrically coupled to said control unit; and a charge port being recessed into said series of steps thereby facilitating said charge port to insertably receive a charge cord, said charge port being electrically coupled to said rechargeable battery for charging said rechargeable battery.

8. A retractable toilet step device to facilitate a child to urinate into a full sized toilet, said device comprising:

a base being positionable against a pedestal of a toilet, said base having a central member extending between a pair of outward members having said pair of outward members being spaced apart from each other, each of said outward members having a bottom end, said central member having a rear edge extending between said pair of outward members, said rear edge being concavely arcuate between said pair of outward members to facilitate said rear edge to accommodate curvature of said pedestal of said toilet having said bottom end of each of said outward members resting on a support surface;

a pair of straps, each of said straps being coupled to said base, said pair of straps being matable to each other to form a closed loop, each of said pair of straps being extendable around said pedestal of said toilet for securing said base to said toilet, each of said straps having a first end and a second end, said first end of each of said pair of straps being coupled to and extending rearwardly from a respective one of said outward members of said base, a respective one of said straps having a clasp being attached to said second end of said respective strap which insertably receives said second end of the other of said pair of straps to form said closed loop of an adjustable diameter;

a series of steps being positioned in front of said pedestal of said toilet, said series of steps being positionable in a stored position having said series of steps resting against said base, said series of steps being positionable in a deployed position having said series of steps being spaced from said base wherein said series of steps is configured to be climbed by a child to facilitate the child to urinate into said toilet, said series of steps having a front wall and an outer wall extending around said front wall, said front wall having a series of vertical faces each being perpendicularly oriented with and being staggered between a series of horizontal faces such that each of said plurality of horizontal faces defines a respective one of said series of steps, said outer wall having a rear edge which defines an opening into said series of steps, each of said horizontal faces being textured wherein said series of horizontal faces is configured to enhance traction for the child; and a motion unit being integrated into said series of steps, said motion unit being attached to said base, said motion unit being actuatable into a retracting condition having said series of steps being positioned against said base, said motion unit being actuatable into an extending condition having said series of steps being spaced from said base, said motion unit including a button which can be depressed for actuating said motion unit between said retracting condition and said extending condition, said series of steps having a hole extending through a topmost one of said series of vertical faces of said front wall of said series of steps, said hole being centrally positioned along a width of said topmost vertical face, said button being positioned in said hole, said motion unit including:

a pair of actuators, each of said actuators being attached to an inwardly facing surface of a respective one of a first lateral side and a second lateral side of said outer wall of said series of steps, each of said actuators including a rod extending outwardly from said outer wall of said series of steps, said rod associated with each of said actuators having a distal end being attached to an interior surface of a respective one of said outward members of said base, said rod associated with a respective one of said actuators being extended outwardly from said respective actuator when said respective actuator is actuated into a first condition thereby urging said series of steps away from said base, said rod associated with said respective actuator being retraced into said respective actuator when said respective actuator is actuated into a second condition thereby urging said series of steps to abut said base;

a control unit being positioned in said series of steps, said control unit being electrically coupled between said button and each of said pair of actuators, each of said pair of actuators being actuated between said first condition and said second condition each time said button is depressed; and a power supply being integrated into said series of steps, said power supply being electrically coupled to said control unit, said power supply comprising:

a rechargeable battery being positioned in said series of steps, said rechargeable battery being electrically coupled to said control unit; and a charge port being recessed into said series of steps thereby facilitating said charge port to insertably receive a charge cord, said charge port being electrically coupled to said rechargeable battery for charging said rechargeable battery.

* * * * *